US005437238A

United States Patent [19]

Price et al.

[11] Patent Number: 5,437,238

[45] Date of Patent: Aug. 1, 1995

[54] WAIST BAND ATTACHMENT SYSTEM

[75] Inventors: Elvin C. Price, Dacula; Preston B. Dasher, Lawrenceville; Gerald C. Valentine, Buford, all of Ga.

[73] Assignee: Atlanta Attachment Company, Lawrenceville, Ga.

[21] Appl. No.: 131,131

[22] Filed: Oct. 4, 1993

[51] Int. Cl.[6] ..... D05B 21/00

[52] U.S. Cl. ..... 112/470.29; 26/98; 112/153; 112/DIG. 2; 112/470.31; 112/475.07; 112/475.09; 139/291 R

[58] Field of Search ..... 112/121.26, 121.27, 112/152, 153, 305, 63, 322, DIG. 2, DIG 3, 262.2; 226/190, 3, 97, 15; 242/615, 908, 566; 139/291 R, 292; 26/98, DIG. 1

[56] References Cited

U.S. PATENT DOCUMENTS

| | | | |
|---|---|---|---|
| 4,046,087 | 9/1977 | Manetti | 112/121.26 X |
| 4,053,967 | 10/1977 | Mair | 26/98 |
| 4,265,187 | 5/1981 | Torre | 112/121.26 |
| 4,473,017 | 9/1984 | Letard et al. | 112/121.26 X |
| 4,484,532 | 11/1984 | Norz | 112/121.26 X |
| 4,928,610 | 5/1990 | Akutsu | 112/151 X |
| 5,269,239 | 12/1993 | Adamski, Jr. et al. | 112/63 X |
| 5,269,257 | 12/1993 | Yamazaki | 112/306 X |

FOREIGN PATENT DOCUMENTS 58-11471 1/1983 Japan .

OTHER PUBLICATIONS

Catalog of Automatic Sewing Units, Components and Other Labor-Saving Devices for the Sewing Industry, by Atlanta Attachment Co., Dec. 1981 pp. 228 and 229.

*Primary Examiner*—Clifford D. Crowder
*Assistant Examiner*—Paul C. Lewis
*Attorney, Agent, or Firm*—Hopkins & Thomas

[57] ABSTRACT

A continuous loop waist band (10) is placed in edge alignment with a garment body (11), and the garment parts are stretched about spindles (19, 20, 21 and 23). The spindles are moved away from one another so as to stretch the aligned edges of the garment parts. The edges of the garment parts tend to curl when stretched, and an edge decurler (84) removes the curl from the stretched garment parts as the edges approach the sewing machine needle (26). Edge guide (102) maintains the plies of material in overlying contact so as to make sure the curls do not reappear in the garment parts as the parts approach the sewing machine.

11 Claims, 6 Drawing Sheets

WAIST BAND ATTACHMENT SYSTEM

FIELD OF THE INVENTION

This invention relates to a method and apparatus for attaching a waist band to the waist edge of a knitted tubular shirt body of a garment, wherein a continuous loop of waist band material is attached to the waist edge of the shirt body by matching an edge of the waist band with the waist edge of the shirt body and advancing the matched edges through a sewing machine.

BACKGROUND OF THE INVENTION

In the production of garments in an industrial setting in which batches of garment parts are delivered to work stations where the garment parts are connected together, it is important that the equipment provided to the worker be fast and efficient in its operation, but also it is important that the garment parts can be expediently loaded on the equipment. Further, it is highly desirable that once the garment parts have been loaded in position and the equipment is placed in operation that the worker be able to momentarily leave the equipment while the equipment continues to operate. This enables the worker to operate more than one machine and to gather more garment parts and match them together for presentation to the machine for its next cycle of operation.

In the production of stretchable garments, such as sweat suits made of stretchable knit material, it is sometimes difficult for the worker to accurately control the material as it is being fed to the sewing machine. For example, when the waist band of a sweat suit is to be connected to the waist edge of the shirt body, the waist band may be of smaller breadth than the waist edge of the shirt body when both garments are relaxed. When the waist band and the waist edge of the shirt body are being guided by hand to the sewing machine, the worker must stretch the waist band with respect to the waist edge of the shirt body in order that they are properly matched in breadth as they are sewn together. Further, the edge portions of the knit material tend to curl as they are stretched, which requires the operator to make sure that the curled edges are flattened before they are presented to the sewing needle of the sewing machine. Because of these inherent problems in presenting the stretchable material by hand to the sewing needles of the sewing machine, the machine operator is required to develop a relatively high skill in presenting the work product to the sewing machine, and the presentation of the work product to the sewing machine requires substantially full attention of the operator during the operation of the sewing machine. This results in the operator not having time during the cycle of operation of the sewing machine to retrieve and assemble the next garment parts that are to be presented to the sewing machine or to operate two machines simultaneously.

SUMMARY OF THE INVENTION

Briefly described, the present invention comprises a method and apparatus for matching the edge to be connected of a loop waist band and the waist edge of a shirt body, stretching the waist band until its breadth is matched with the breadth of the waist edge of the shirt body, and advancing the matched edges along the sewing path of the sewing machine. A decurling assembly is placed in the upstream portion of the sewing path so as to remove any curl in the edges of the garment parts as they approach the sewing machine. The garment parts are allowed to advance toward the sewing needles a distance sufficient to allow the decurled portions of the garment parts to reach the sewing machine needles before the sewing machine is activated, thus assuring that the edges of the garment parts will be flattened before they are connected together. In the meantime, the matched edges moving between the decurler and the sewing needles passes through an edge guide that controls the edges of the garment parts as they advance to the sewing needles, as well as making sure that the edges of the garment parts remain in flat abutment, with the edges matched together without curling. Later, the decurler retracts from the garment parts so that it is out of the way as the previously sewn matched edges of the garment parts return to the sewing needles.

After the sewing cycle has been completed and the entire lengths of the edges of the waist band and shirt body have been properly sewn together, the edge guide pushes the matched and now sewn edges of the garment parts laterally out of the sewing path, so that a smooth transition is formed in the stitching as the sewing machine sews off the garment.

A set of guide spindles is mounted to the work table of the sewing machine and project out parallel to one another in front of the sewing machine. The worker places the waist band in straddling relationship about the spindles, with an edge of the waist band positioned in the sewing path of the sewing machine. The waist edge of the shirt body is then telescopically mounted about the waist band, about the same guide spindles, with its edge matched with the edge of the waist band, in the sewing path. Some of the spindles are then moved laterally so as to move away from one another and therefore expand the waist band and waist edge of the shirt body, so that both the waist band and the waist edge of the shirt body are under tension and the lengths of the matched edges of the garment parts are substantially the same as they pass through the sewing machine.

At least some of the guide spindles which are used to guide the work product through the sewing machine have an elongated, generally cylindrical body, rounded at one end and including a radially extending flange at its other end. The flange is approximately aligned with the sewing path through the needles of the sewing machine, and the rounded end of the spindle extends away from the sewing path. The elongated body of the spindle has a tapered portion converging toward the flange, and an annular recess is formed in the body of the spindle at a position intermediate the rounded end and the tapered portion. This spindle configuration tends to hold the waist band and the waist edge of the shirt body in proper position as the spindles are rotated and the garment parts are moved progressively into the sewing needles of the sewing machine. The converging tapered portion of the spindles tends to assure that the edges of the garment parts abut the flange of the spindle, thereby maintaining alignment of the matched edges of the garment parts in the sewing path.

Therefore, it is an object of this invention to provide an improved method and apparatus for attaching an uninterrupted looped waist band to the waist edge of an approximately tubular body garment such as a tubular shirt body, in which the waist band and shirt body can be presented to the sewing machine by the worker, and the sewing function can commence and continue until completed while the worker is free to perform other functions.

Another object of this invention is to provide an improved waist band attachment system for a sewing machine which functions to automatically feed and decurl the matched edges of a waist band and the waist edge of a tubular shirt body of a sweat suit or similar garment made of stretchable materials as the garment parts move along the sewing path of the sewing machine.

Another object of this invention is to provide an improved set of guide spindles for maintaining the edges of stretchable garment parts in matched alignment while accurately guiding the matched edges of the garment parts along the sewing path of a sewing machine.

Another object of this invention is to provide a system for expediently and accurately loading stretchable garment parts in a sewing position at a sewing machine, and which functions to sew the garment parts together without requiring the attention of a sewing machine operator during the sewing function.

Another object of this invention is to provide a garment support assembly mounted to the work table of a sewing machine which functions to support and guide garments during a sewing function, and which can be rapidly adjusted to accommodate different size garments, and which can be moved out of the way and replaced as may be necessary in repairing and maintaining the sewing machine.

Other objects, features and advantages of the present invention will become apparent upon reading the following specification, when taken in conjunction with the accompanying drawing.

DETAILED DESCRIPTION

Figures 1, 4:
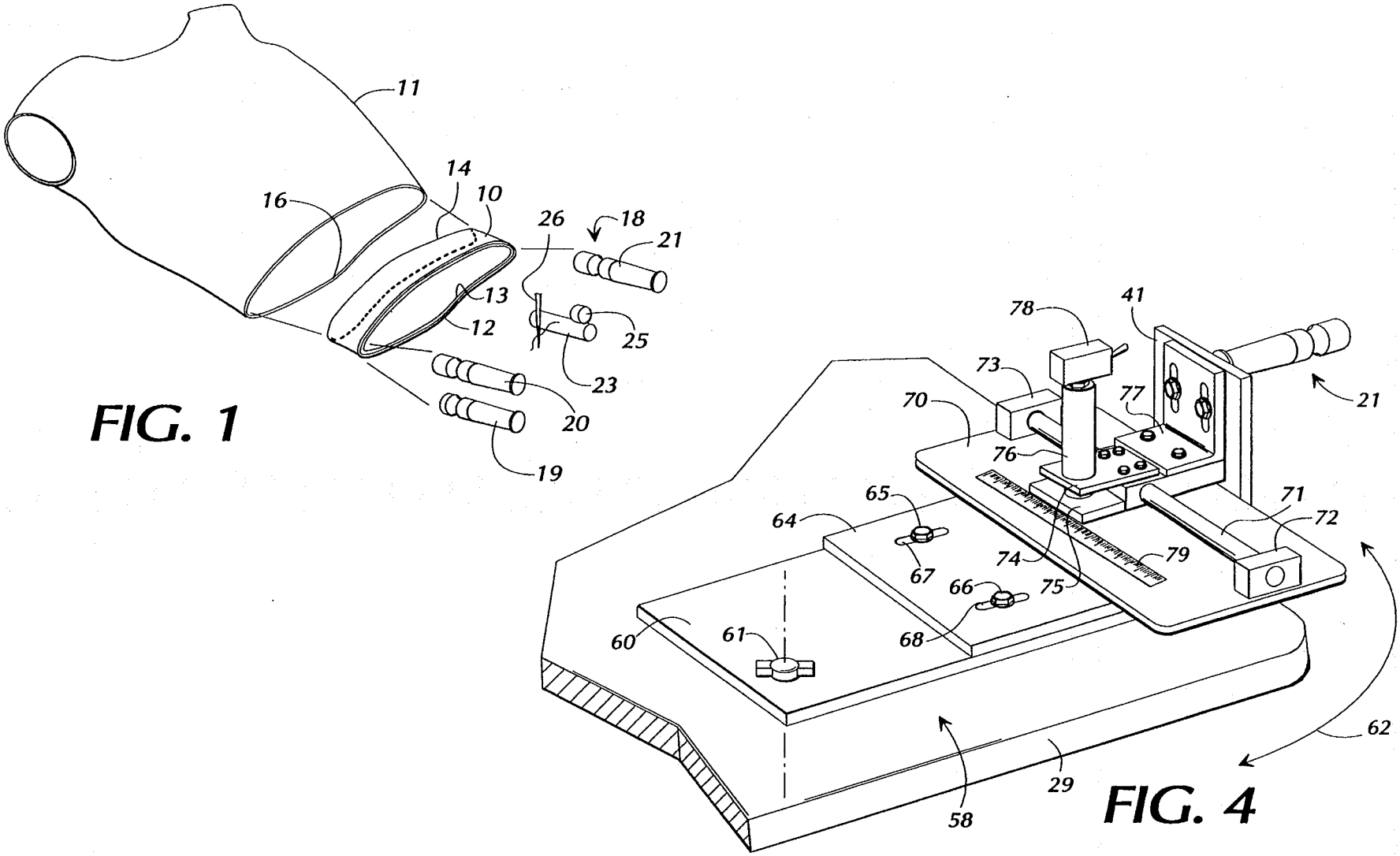
FIG. 1 is a perspective illustration of a tubular shirt body and a waist band of a garment prior to being connected together, and illustrating how those parts of the garment would be placed in straddled relationship about the guide spindles of the system.
FIG. 4 is a perspective illustration of one of the adjustable support assemblies for an upper spindle.

Referring now in more detail to the drawings, in which like numerals indicated like parts through the several views, FIG. 1 illustrates a waist band 10 and a shirt body 11 of an upper body garment. The waist band is of a continuous loop formation, and is doubled over on itself so that its edges 12 and 13 are matched in lateral alignment. The other edge 14 is folded. The waist edge 16 of the shirt body 11 is to be laterally matched with the matched edges 12 and 13 of the waist band. The sewing machine includes a trimmer which trims the edges of the work product.

Figure 7:
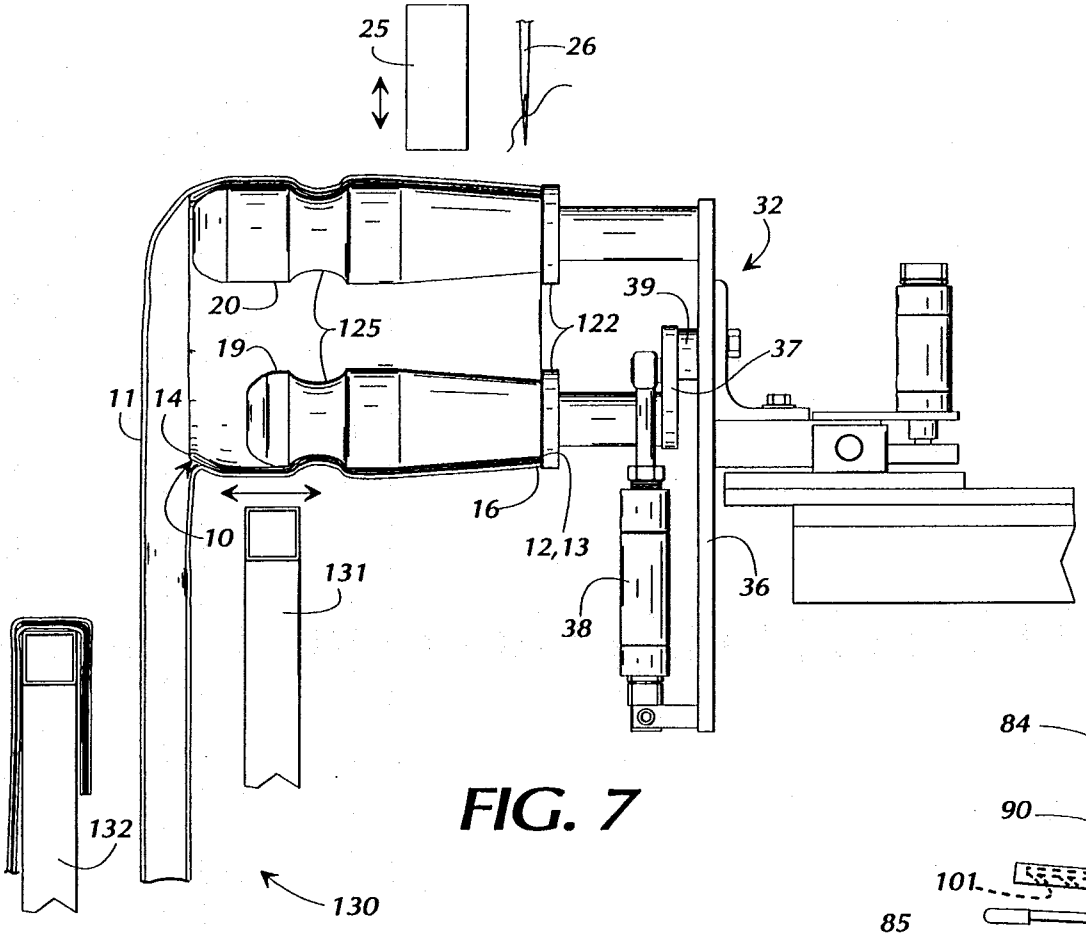
FIG. 7 is an end view of the upper entrance guide spindle and the lower expansion spindle at the upstream end of the sewing path, the drive wheel, and the upper portions of the stacker which removes the finished garment parts from the guide spindles.

The spindle guide assembly 18 includes a plurality of guide spindles 19, 20 and 21 which function to guide the garment parts along the sewing path of the sewing machine. The waist band 10 is arranged in its folded configuration as illustrated in FIG. 1 by the machine operator, and then is placed in straddling relationship about all of the spindles 19, 20 and 21, and between drive spindle 23 and drive roller 25, in the sewing path that extends through the position of sewing needle 26 of sewing machine 28. Likewise, the waist edge 16 of the shirt body 11 is telescoped over the waist band so that its waist edge 16 is laterally matched with the edges 12 and 13 of the waist band. As shown in FIG. 7, the edges 12, 13 and 16 are all placed so that they abut the flange of the spindles. The additional spindle 23 (FIG. 1) is placed in lateral alignment with spindles 20 and 21, and upper drive wheel 25 is movable toward and away from spindle 23 so as to clamp the garment parts therebetween and to advance the garment parts along the sewing path. As the garments are advanced along the sewing path, the sewing needle 26 and the other components of the sewing machine function to sew the edges 12, 13 and 16 together. The sewing machine 28 is the type that includes an edge trimmer which trims the edges of the plies of material passing through the sewing needles.

Figure 2:
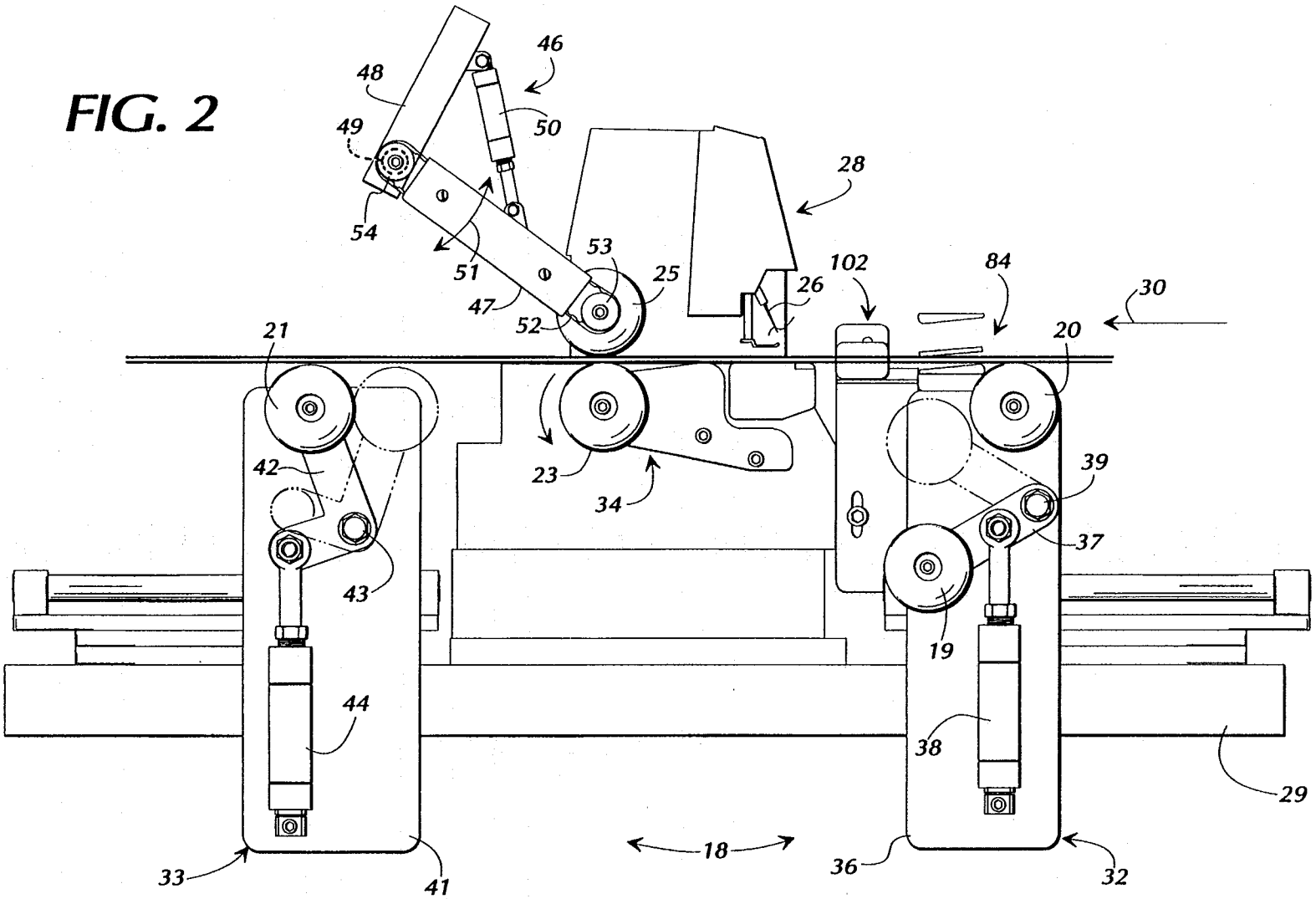
FIG. 2 is a front elevational view of the sewing machine and the waist band attachment system.
Figure 3:
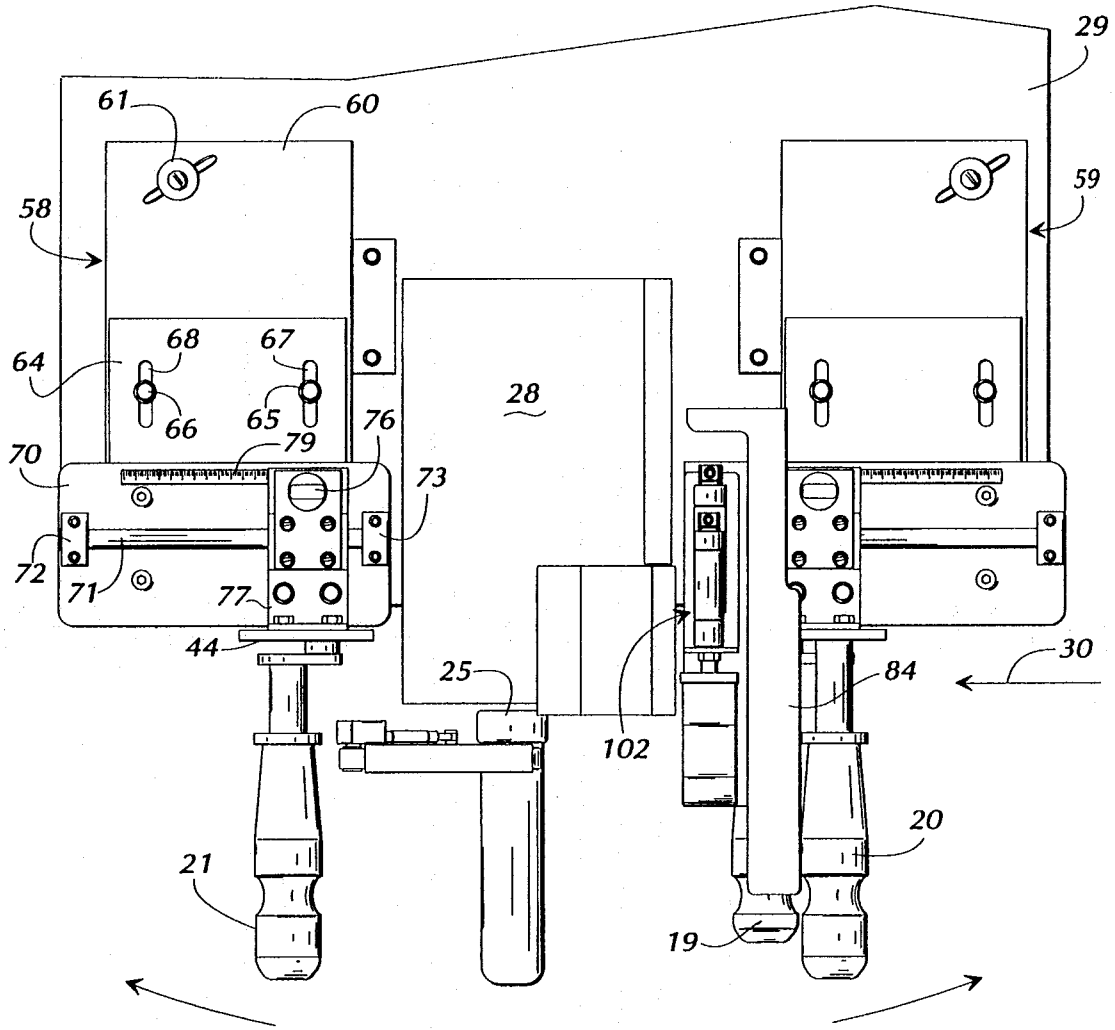
FIG. 3 is a plan view of the sewing machine and waist band attachment system of FIG. 2.

As illustrated in FIGS. 2 and 3, the sewing machine 28 is mounted on a work table 29 in the conventional manner, and the work product is arranged to be moved through the sewing machine from right to left (FIG. 2), as shown by arrow 30, which is coincident with the sewing path of the sewing machine.

The spindle guide assembly 18 includes an entrance spindle assembly 32 and a return spindle assembly 33, and a feed spindle assembly 34 is positioned intermediate the entrance and return spindle assemblies. Entrance spindle assembly 32 includes a vertically oriented support plate 36, entrance guide spindle 20 rotatably mounted to the support plate, and lower expansion spindle 19 rotatably mounted to an end of support arm 37. Pneumatic cylinder 38 is mounted at its base to support plate 36 and its cylinder rod is connected to the other end of support arm 37 and functions to pivot the support arm about its pivot pin 39 so as to raise and lower the lower expansion spindle 19 between its full line and dash line positions. This movement of the spindle 19 has the effect of expanding and stretching the waist band and shirt body, or relaxing the waist band and shirt body which straddle the spindles 19, 20 and 21.

Likewise, return spindle assembly 33 includes a vertically oriented support plate 41 which is oriented in the same plane as support plate 36. Return spindle 21 is rotatably mounted to support arm 42, which in turn is pivotal about pivot pin 43, and pneumatic cylinder 44 which is mounted to support plate 41 is attached to support arm 42 and is arranged to pivot the support arm and its return spindle 21 between the full line and dash line positions. Therefore, arcuate movement of the return spindle 21 has the effect of stretching or relaxing the waist band and shirt body which straddle the spindles 19, 20 and 21.

Drive spindle 23 is mounted just beneath the sewing path of the sewing machine. Drive system 46 is mounted above drive spindle 23 and includes drive wheel support arm 47 pivotally mounted at one end to stationery frame element 48 by pivot pin 49. Pneumatic cylinder 50 is connected at one of its ends to frame element 48 and at its other end to drive wheel support arm 47, so as to lift and lower the drive wheel support arm 47 in the directions as indicated by arrows 51. This causes drive wheel 25 to move down toward engagement with drive spindle 23. Timing belt 52 extends about sheaves 53 and 54 on support arm 47, and a motor (not shown) is arranged to rotate sheave 54, which, through timing belt 52, drives sheave 53 and drive wheel 25. The motor is a stepping motor and is driven in unison with the sewing machine motor. When the garment parts are placed about the spindles 19–21 and about spindle 23, the drive wheel 25 will be in its up position, spaced away from the drive spindle 23. When the sewing cycle is initiated, the drive wheel 25 will be lowered by its cylinder 50 down toward engagement with the work product, to bias the work product into engagement with the drive spindle 23, and as the motor rotates drive wheel 25, the drive wheel and its spindle 23 rotate in unison and advance the work product along the sewing path about the spindles 19–21. Spindles 19–21 and 23 are idle spindles, in that they are freely rotatable, and they rotate in response to the movement of the work product about them.

As illustrated in FIGS. 3 and 4, the entrance spindle assembly 32 and return spindle assembly 33 are each mounted on adjustable spindle supports 58 and 59. As illustrated in FIG. 4, adjustable spindle support 58 includes pivot plate 60 mounted in flat abutment with the top surface of work table 29 which is connected to the work table by pivot pin 61. The pivot pin comprises the only connection between pivot plate 60 and work table 29 so that the pivot plate can pivot about pivot pin 61 as indicated by double headed arrow 62 (FIG. 4). This allows the return spindle 21 to swing toward and away from the sewing machine, so that it can be pivoted out of the way when maintenance work is to be performed on the sewing machine, or pivoted back to its operative position.

Alignment plate 64 is placed in flat abutment against pivot plate 60 and is connected thereto by screws 65 and 66 which extend through the slots 67 and 68 of plate 64 and into threaded openings (not shown) in the lower pivot plate 60. The screw and slot arrangement allows the alignment plate to be moved fore and aft with respect to the work table 29, so as to cause return spindle 21 to be laterally aligned with the other spindles of the system.

Lateral adjustment plate 70 is fixedly mounted to alignment plate 64 and includes slide bar 71 suspended above the lateral adjustment plate 70 by support blocks 72 and 73, and slide block 74 is slidably mounted on slide bar 71. Lock block 75 is supported in the downwardly facing recess of slide block 74, and pneumatic cylinder 76 is mounted on slide block 74 and its rod (not shown) extends through the slide block and is connected to lock block 75. A valve 78 is mounted to cylinder 76 and is arranged to charge the cylinder with air under pressure, so as to urge the lock block downwardly into firm engagement with respect to lateral adjustment plate 70, thereby locking the slide block 74 in a fixed position with respect to the lateral adjustment plate 70. When the air pressure is released from cylinder 76, the slide block is free to slide along the length of the slide bar 71 to other positions, as denoted by the longitudinal scale 79 imposed on the surface of lateral adjustment plate 70. Thus, with a flip of the toggle switch of the valve 78, the operator can release the slide block 74 from its locked relationship with respect to the lateral adjustment plate 70 and slide the slide block and its spindle 21 to a new position as denoted by the scale 79, and then with another flip of the toggle switch, lock the spindle and slide lock in their new positions. When the operator is changing size of the garments to be handled by the system, the scale 79 can be used to reposition the spindle 21 to the proper position to accommodate larger or smaller size garments. L-shaped bracket 77 rigidly fastens support plate 41 to the slide block 74.

Adjustable spindle support 59 on the opposite side of the sewing machine 28 is constructed in substantially a mirror image of the adjustable spindle support 58, as illustrated in FIG. 3.

Figure 5:
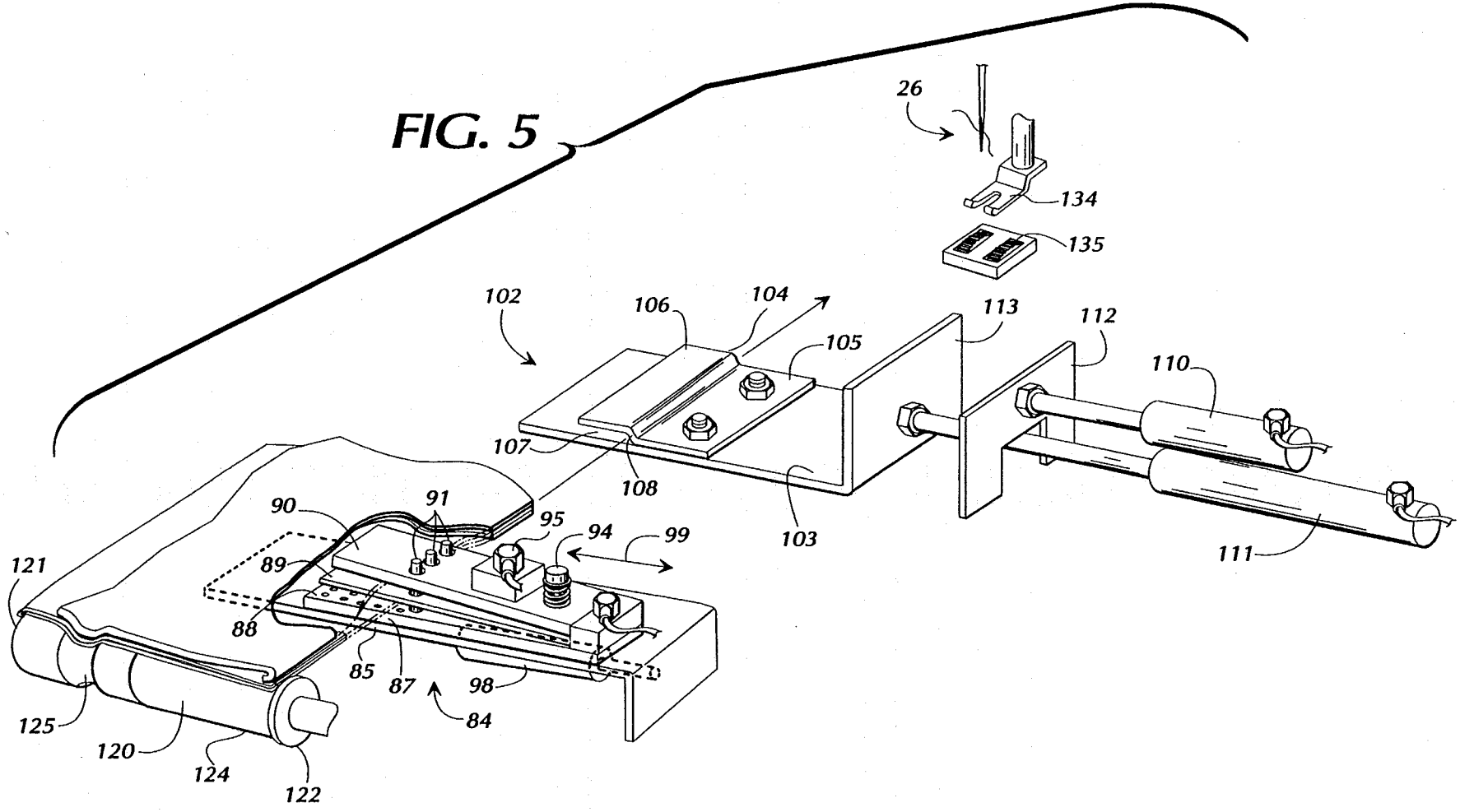
FIG. 5 is a perspective illustration of one of the guide spindles, the decurler, the edge guide, and the upper needle, presser foot and feed dogs of the sewing machine.
Figure 6B:
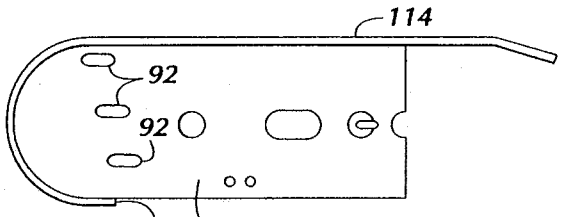
FIG. 6B is a top view of the separator plate of the decurler of FIG. 6A.
Figure 6A:
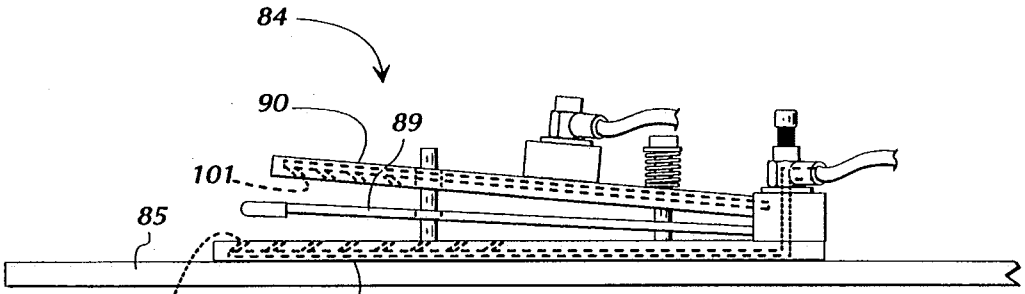
FIG. 6A is a side view of the decurler, with the air passages shown in dash lines.

As illustrated in FIGS. 5 and 6A, the edge decurler 84 is positioned between the entrance guide spindle 20 and the upper sewing needle 26 of the sewing machine 28, and comprises an elongated, flat support plate 85 which extends beneath the sewing path and projects in supporting relationship with respect to the work product as the work product is moving along the sewing path. Lower decurler plate 87 is supported on the support plate 85 with its distal end portion 88 projecting into the path of the work product, pivotal separator plate 89 and upper clamp plate 90 also project into the path of the work product, and with their distal ends aligned with and overlying the distal end 88 of the lower decurler plate 87. Guide pins 91 are mounted at their lower ends to lower decurler plate 87 and extend upwardly through enlarged openings 92 of separator plate 89 (FIG. 6B) and clamp plate 90. Coil compression spring assembly 94 is mounted adjacent the proximal ends of the separator plates 87, 89 and 90 and assist in urging the upper clamp plate and intermediate separator plate downwardly toward the lower decurler plate 87. Pneumatic actuator 95 is arranged to lift and spread apart the intermediate separator plate and the upper clamp plate.

With this arrangement, when the separator plate and clamp plate are lifted and spread apart, the operator can insert the matched edges of the waist band between the lower decurler plate 87 and the intermediate separator plate 89, and can insert the waist edge of the shirt body between the separator plate 89 and the clamp plate 90. Once the edges have been properly positioned as described, the cycle of the machine can begin and the air pressure through air actuator 95 is relieved so that the spring 94 and gravity tend to pull the plates 89 and 90 downwardly, so as to press the layers of material therebetween. Therefore, the edges of the material move about opposite sides of the separator plate.

When the sewing machine has completed most of its operating cycle so that the first portion of the waist band and shirt body have been sewn together and have now progressed about the spindles 21, 19 and 20 and are about to approach the sewing machine for the second time, it is necessary to withdraw the decurler from the path of the work product so that the decurler will not interfere with the oncoming stitched edges of the work product. Accordingly, pneumatic cylinder 98 positioned beneath elongated support plate 85 distends and therefore pushes the decurler away from the path of the work product. Once the system has completed its cycle, the decurler is moved back in the opposite direction where it will be repositioned in the path of the next work product. This is indicated by the double headed arrow 99.

As illustrated in FIGS. 2, 3 and 5, the edge guide 102 is positioned between the edge decurler 84 and the upper sewing needle 26 and comprises a base plate 103 that projects out beneath the sewing path of the sewing machine, and upper generally Z-shaped guide plate 104 that has a lower segment 105 mounted to base plate 103 and upper segment which is spaced above and oriented parallel to the base plate 103, forming a slot 107 for receiving the matched edges of the waist band and waist edge of the shirt body of the garment. Pneumatic cylinders 110 and 111 control the three position movements of the edge guide 102. When both cylinders 110 and 111 are retracted, the edge guide 102 is retracted away from the work product so that it does not engage the work product. However, when pneumatic cylinder 110 is distended, it moves its inverted U-shaped pusher 112 into engagement with the upturned base segment 113 of the base plate 103, causing the edge guide to move into the path of the sewing machine, so that the guide slot 107 receives the matched edges of the work product. The vertical segment 108 of the upper guide plate will push the matched edges of the work product into alignment with the sewing needle 26, if necessary. In the meantime, the vertical dimensions of the slot 107 are such that this pushing action will not result in curling of the matched edges of the work product.

As illustrated in FIG. 6A, lower decurler plate 87 and upper clamp plate 90 both have hollow interiors as indicated by the dash lines, and nozzle openings 100 and 101 respectively are formed in the distal end portions of the plates so as to direct streams of air against the plies of work product passing about separator plate 89. The streams of air are directed away from the distal ends of the plates 87, 89 and 90, back between the plates, so as to tend to decurl or straighten any curled edge portion of the plies of material passing about the separator plate 89. In the meantime, separator plate 89 causes the plies to be separated from each other so that this decurling function is not retarded by the plies of material tending to cling together.

As shown in FIG. 6B, J-shaped air tube 114 is mounted to a side edge of separator plate 89, having an air outlet 115 directed from the distal end back toward the proximal end of the separator plate, so that a stream of air emitted from the air tube tends to uncurl the edge of the work product approaching the decurler.

As the work cycle of the sewing machine comes to an end and it is necessary to remove the work product from the sewing machine, as detected by the stitch count of the control system, the lower pneumatic cylinder 111 begins to progressively move edge guide 102 farther into the path of the work product, so that the vertical segment 108 causes the work product to drift away from the sewing path and the sewing needles, so that the needle begins to run off the work product. The pneumatic cylinder 111 continues to push the edge guide 102 farther away from the sewing path so that the work product is now completely separated from the sewing machine and is free to be removed from the spindle guide assembly 18. Once this has been accomplished, both pneumatic cylinders 110 and 111 retract so as to bring the edge guide 102 to its retracted position which is out of the way of the sewing path.

As best illustrated in FIGS. 5 and 7, an important feature of the invention is the shapes of the guide spindles 19, 20 and 21. For example, each spindle has an elongated, generally cylindrical body 120, rounded at its distal end 121 and including a radially extending flange 122 at its proximal end. The flange is approximately aligned with the sewing path through the needles of the sewing machine, while the rounded end extends away from the sewing path. The elongated body of each spindle also has a tapered portion 124 that converges inwardly toward the flange 122, and an annular recess 125 is formed about the body portion at a position intermediate the rounded end and the tapered portion. While spindles 20 and 21 are of identical size and shape, lower expansion spindle 19 is foreshortened in that its rounded end does not project as far out from its flange and the sewing path as the rounded ends of the other two spindles. However, the annular recesses 125 and the flanges 122 of the spindles 19, 20 and 21 are aligned with one another.

When the waist band and shirt body are mounted in straddling relationship with respect to spindles 19, 20 and 21, their matched edges are arranged to abut flanges 122, and the portions of the waist band and shirt body adjacent their matched edges rest on the tapered portion 124 of the spindles. Thus, when the system is placed in operation and the waist band and shirt body revolve about the spindles, there is a slight tendency of the tapered portion of the spindles to draw the waist band and shirt body toward flanges 122 of the spindles. This assures that the work products will not drift off of the spindles and become misaligned with the sewing path.

In the meantime, the annular recesses 125 of all the spindles 19, 20 and 21 function as a relief in the tension applied by the spindles to the work products. The recesses 125 tend to assure that the work products will not shift longitudinally with respect to the spindles.

It will be noted that lower expansion spindle 19 is of shorter length than the entrance guide spindle 20. This foreshortened length of the lower spindle allows the shirt body of the garment to drape downwardly about the rounded end of the lower spindle 19 without forming a wrinkle in the shirt body that would tend to be carried about the entrance guide spindle 20, and which might interfere with the accurate sewing function of the system.

As further illustrated in FIG. 7, a stacker system 130 is positioned in the vicinity of the distal ends of the spindles, below the spindles, so as to engage and pull the work products away from the spindles. The movable stacker arm 131 is positioned on one side of the draped garment parts hanging from the spindles, while the other arm 132 is positioned lower than the arm 131 and farther away from the spindles, so that when movable arm 131 swings out from beneath the spindles, it tends to pull the garment off the spindles and flip the upper portion of the garment over the lower arm 132. This stacking motion is timed to take place when the sewing function has been completed and the spindles have been retracted and have relaxed the work product.

OPERATION

When the waist band attachment system is to be placed in operation, the system is at rest with the spindles retracted and the operator places the folded waist band 10 and the waist edge of the shirt body 11 about the retracted spindles 19, 20 and 21, with the matched edges 12 and 13 of the waist band 10 and the matched edge 16 of the shirt body 11 being placed in alignment with the sewing path of the sewing machine. The operator loads the machine with the matched edges of the garment parts in abutment with the flanges 122 of the spindles 19, 20 and 21, and with the waist band extending beneath pivotable separator plate 89 of the edge decurler, and with the waist edge 16 of the shirt body positioned over the pivotable separator plate 89. The operator is not required to remove any curl from the matched edges of the segments of material which extend between the spindles.

Figure 8:
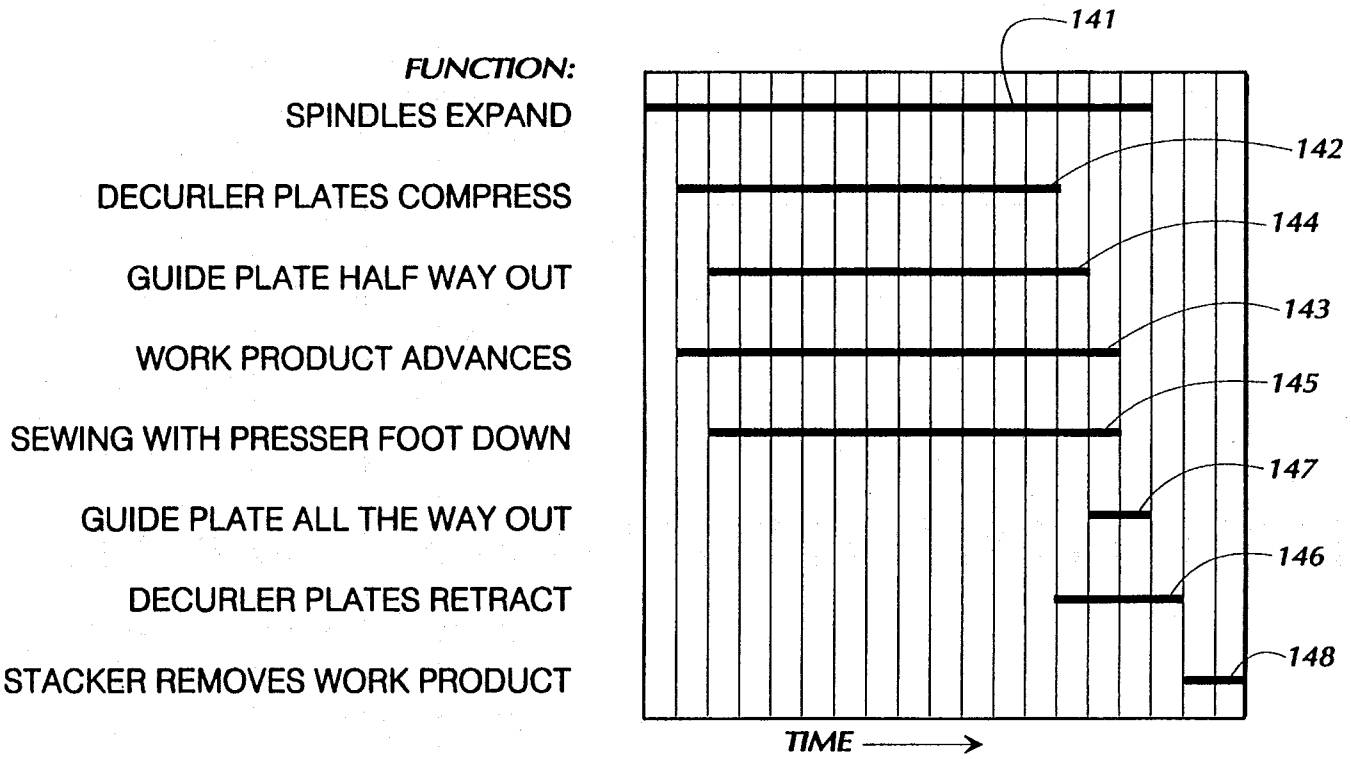
FIG. 8 is a time diagram which illustrates the timing of the functions of the waist band attachment system.

As illustrated in the timing diagram of FIG. 8, once the garment parts have been properly positioned on the spindles, the operator depresses a button (not shown) to initiate the cycle of the machine. At this point, the operator is free to turn and operate a duplicate machine. When the operator depresses the start button of the system, the lower expansion spindle 19 and return spindle 21 move away from entrance guide spindle 20 as indicated at 141 of FIG. 8, thereby applying tension to the waist band and to the waist edge of the shirt body, causing these edges to be of the same breadth.

As soon as the spindles have been expanded, the decurler plates 87, 89 and 90 compress together as indicated at 142 so as to lightly clamp the plies of material against the intermediate separator plate 89 and streams of air are emitted from the nozzles 101 (FIG. 6) of the lower and upper clamp plates 87 and 90, tending to remove the curl from the plies of material. At the same time, the drive wheel 25 (FIG. 2) moves down into engagement with the work product, being biased against the drive spindle 23, and the drive wheel begins its rotation so as to advance the work product along the sewing path, indicated at 143 of FIG. 8. In the meantime, the edge guide 102 (FIG. 5) moves out to its halfway position so that its slot 107 receives the matched edges of the work product, shown at 144. In the meantime, the decurled portion of the work product will have moved to the position of the edge guide 102, and the edge guide will assure that the matched edges of the work product are properly aligned in the sewing path and that the matched edges do not tend to part from each other as they are advanced to the sewing needle 26.

After the work product has been advanced by feed roller 25 (FIG. 2) (which is driven by a stepping motor, not shown) a pre-determined distance as determined by an adjustable timer, the presser foot 134 of the sewing machine 28 moves down and the needle 26 begins its reciprocation, as the feed dogs 135 gain control of the movement of the work product on through the system, indicated at 145. This delay of the operation of the needle, presser foot and feed dogs allows the work product to have been decurled before it reaches the sewing station of the sewing machine.

The system is allowed to continue in operation until the first portion to have been sewn of the work product begins to return to the entrance guide spindle 20, as determined by a stitch count. Just as the first stitched portion reaches the decurler 84, its cylinder 98 retracts the decurler from the work product so that the decurler is out of the way and does not interfere with the movement of the stitched portion back to the sewing station, indicated at 146. When the stitched portion finally reaches the sewing station, it is time for the system to sew off the work product. The edge guide 102 is then moved to its fully distended position, indicated at 147, whereupon the work product is guided out from beneath the sewing needle and is no longer connected by threads to the sewing needles. At this point, the spindles retract, 141, the operation of the sewing machine and the advancement of the work product terminate, 145 and 143, and the stacker (FIG. 7) pulls the work product off the retracted spindles and forms a stack of work products, 148. The system is now available for a second cycle.

Although the system has been described as attaching a waist band to the waist edge of a shirt body of an upper body garment, it should be understood by those skilled in the art that other types of garments can be handled by the system. The term shirt body is to be interpreted to include a lower body garment, such as skirts or pants which can be connected to a waist band by the disclosed system. Further, while a folded waist band has been described, unfolded waist bands can be handled by the system.

While a preferred embodiment of the invention has been disclosed in the foregoing specification and drawing, it should be apparent to those skilled in the art that variations and modifications thereof can be made without departing from the spirit and scope of the invention as set forth in the following claims.

We claim:

1. A method of attaching an uninterrupted loop waist band to the waist edge of a shirt body of an approximately tubular garment comprising the steps of:

placing the waist band about a plurality of support spindles with an edge of the waist band aligned with the sewing path of a sewing machine, placing the waist edge of the shirt body of the garment about the waist band with the edge of the shirt body substantially matched with the edge of the waist band and aligned with the sewing path, stretching the waist band and waist edge of the shirt body until both the waist band and waist edge of the shirt body are under tension, advancing the stretched waist band and the waist edge of the shirt body along the sewing path, applying a stream of air to the matched edges of the stretched shirt body and the waist band at a position along the sewing path upstream of the sewing needles in a direction that removes any curl from the matched edges and orients the matched edges in flat overlying relationship with one another as the waist band and shirt body move toward the sewing needles of the sewing machine, delaying the sewing function of the sewing machine until after the portion of the waist band and waist edge of the shirt body which have had the stream of air applied thereto have reached the needles of the sewing machine, and initiating the sewing function of the sewing machine to connect the matched edges of the waist band and shirt body together.

2. The method of attaching a waist band to the waist edge of a shirt body of a garment as set forth in claim 1 and further including the step of:

stretching the waist band and the waist edge of the shirt body during the step of removing any curl in the edges of the waist band and shirt body.

3. The method of attaching a waist band to the waist edge of a shirt body of a garment as set forth in claim 1 and wherein the step of applying a stream of air to the matched edges includes the step of:

passing the waist band and the waist edge of the shirt body on opposite sides of a separator plate, and directing streams of air against the waist band and shirt body as the waist band and shirt body traverse the separator plate in directions that induce any curl in the matched edges of the waist band waist edge of the shirt body to be removed.

4. The method of attaching a waist band to the waist edge of a shirt body of a garment as set forth in claim 1 and wherein the step of initiating the sewing function of the sewing machine comprises:

lowering a presser foot against the waist band and shirt body.

5. A process of connecting edges of curled edge plies of tubular material comprising the steps of:

placing an edge portion of one ply of material beneath a separator plate in alignment with a sewing machine, placing an edge portion of a second ply of material over the separator plate and in alignment with the sewing machine with the edge portions of the plies of material laterally matched with each other and in contact with each other on opposite sides of the separator plate, stretching the edge portions of the plies of material so that the edge portions tend to curl, advancing the stretched edge portions of the plies of material about the separator plate and through the sewing machine, uncurling any curl in the plies of material at the separator plate as the plies of material pass about the separator plate and toward the sewing machine, maintaining the uncurled plies of material in flat abutment with each other AS the plies of material approach the sewing machine, and initiating the sewing together of the edge portions of the plies of material after the plies of material have been stretched and uncurled and have been advanced to the sewing machine.

6. The process of claim 5 and further including the step of mounting the tubular plies of material in a straddling relationship about a plurality of spindles and revolving the plies of material about the spindles.

7. An attachment for a sewing machine for guiding a stretchable loop waist band and the waist of a tubular garment part to the sewing machine comprising:

guide spindles for holding the edges to be connected of the waist band and the tubular garment in side-by-side matched relationship in the sewing path of the sewing machine, drive means for moving the matched edges along the sewing path through the sewing machine, and decurling means positioned in the sewing path upstream of the sewing machine for removing curl from the matched edges of the waist band and the waist edge of the tubular garment as the matched edges move toward the sewing machine, means for delaying the operation of the sewing function of the sewing machine to sew the matched edges together until after the matched edges of the waist band and tubular garment part have been decurled by the decurling means and have been moved to the sewing machine.

8. The attachment for a sewing machine as set forth in claim 7 and further including means for removing said decurling means from the sewing path of the sewing machine as the first portion of the matched edges of the waist band and the tubular garment which have been sewn together return to the sewing machine.

9. The attachment for a sewing machine as set forth in claim 7 and further including means for stretching the waist band and the waist edge of the tubular garment to substantially the same breadth as the matched edges are decurled and sewn together.

10. The attachment for a sewing machine as set forth in claim 7 and wherein said spindle mounting means comprises at least two spindles, a first of said spindles positioned upstream of the sewing machine for guiding the matched edges of the waist band and tubular garment part along the sewing path toward the sewing machine and the second of said spindles positioned down stream of the sewing machine for guiding the matched edges of the waist band and tubular garment part back toward the one spindle, each of said spindles including an elongated body, rounded at a distal end, a radially extending flange at its other end in alignment with the sewing path of the sewing machine, and a tapered portion converging toward said flange, so that the matched edges of the waist band and the waist edge of the tubular garment part are placed in straddling relationship about the spindles on the tapered portions of the spindles and the tapered portions of the spindles assure that the matched edges remain in abutment with the flanges as the matched edges move about the spindles.

11. The attachment for a sewing machine of claim 7 and further including edge guide means positioned up stream of the sewing machine and between said decurler and the sewing machine, said guide means defining a slot sized to slidingly receive the matched edges of the waist band and tubular garment part as the matched edges move toward the sewing machine, means for moving the slot of said guide means between a first position withdrawn from the sewing path, a second position in the sewing path in which the slot of said guide means straddles and guides the matched edges toward the sewing machine, and a third position which guides the matched edges away from the sewing path.

* * * * *